US009038990B2

(12) United States Patent
Krappinger et al.

(10) Patent No.: US 9,038,990 B2
(45) Date of Patent: May 26, 2015

(54) CABLE WINCH DEVICE

(75) Inventors: Reinhard Krappinger, Hoechst (AT); Eugen Schobesberger, Roethis (AT); Alexander Koehler, Feldkirch (AT)

(73) Assignee: Liebherr-Werk Nenzing Ges.m.b.H, Nenzing (AT)

( * ) Notice: Subject to any disclaimer, the term of this patent is extended or adjusted under 35 U.S.C. 154(b) by 134 days.

(21) Appl. No.: 13/609,900

(22) Filed: Sep. 11, 2012

(65) Prior Publication Data

US 2013/0240809 A1 Sep. 19, 2013

(30) Foreign Application Priority Data

Sep. 12, 2011 (DE) ..... 10 2011 113 210

(51) Int. Cl.
*B66D 1/00* (2006.01)
*B66D 1/39* (2006.01)
*B66D 1/36* (2006.01)

(52) U.S. Cl.
CPC ... *B66D 1/39* (2013.01); *B66D 1/36* (2013.01)

(58) Field of Classification Search
CPC ..... B66D 1/39
USPC ..... 254/329–332, 333, 334
See application file for complete search history.

(56) References Cited

U.S. PATENT DOCUMENTS

| | | | | |
|---|---|---|---|---|
| 3,456,899 | A | 7/1969 | Smith et al. | |
| 3,804,370 | A * | 4/1974 | Woodard | 254/331 |
| 4,087,060 | A | 5/1978 | Laky et al. | |
| 4,350,323 | A | 9/1982 | Charles et al. | |
| 4,650,163 | A * | 3/1987 | Peterson | 254/327 |
| 5,634,628 | A * | 6/1997 | Schuch | 254/331 |
| 6,520,485 | B1 * | 2/2003 | Soot | 254/331 |

FOREIGN PATENT DOCUMENTS

| | | | |
|---|---|---|---|
| DE | 2138971 | A1 | 2/1972 |
| DE | 8710351 | U1 | 1/1988 |
| DE | 102009036356 | A1 | 2/2011 |
| EP | 953539 | A2 | 11/1999 |
| FR | 2044130 | A5 | 2/1971 |
| FR | 2417466 | A1 | 9/1979 |
| GB | 2183212 | A | 6/1987 |
| JP | 20012379 | U1 | 1/2001 |
| SU | 1622285 | A1 | 1/1991 |

* cited by examiner

*Primary Examiner* — Emmanuel M Marcelo
(74) *Attorney, Agent, or Firm* — Dilworth & Barress, LLP

(57) ABSTRACT

A cable winch device, particularly a cable winch device for a crane, has at least one cable winch with at least one cable, with the cable wound and/or unwound at least partially on the cable winch. The cable winch can be shifted and/or moved at least partially substantially along the longitudinal axis of the cable winch. A crane, particularly a deep sea crane, has at least one such cable winch device.

17 Claims, 1 Drawing Sheet

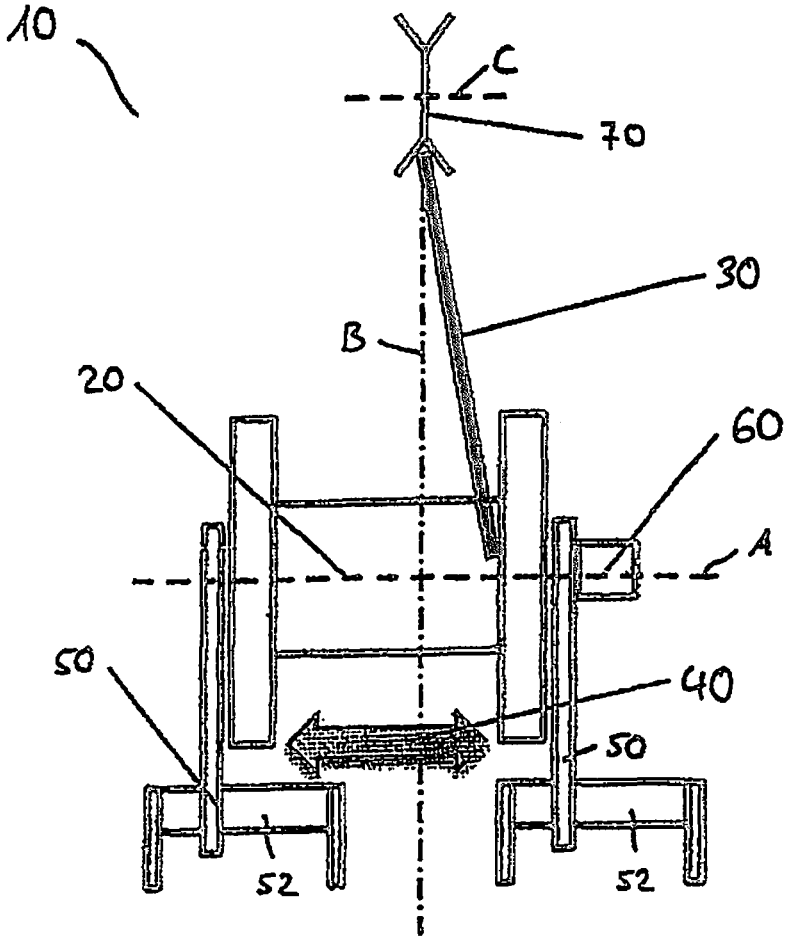
10
C
70
30
B
20
60
A
50
40
50
52
52

CABLE WINCH DEVICE

BACKGROUND OF THE INVENTION

The present invention relates to a cable winch device having at least one cable winch, with at least one cable, wherein the cable is wound and/or can be wound and/or unwound on the cable winch, as well as to a crane, particularly a deep sea crane, having a cable winch device, wherein the cranes can, however, be any type of crane in principle.

Cranes, particularly deep sea cranes, have cable winches on which the suspension cable is wound. Since the cables to be used occasionally have a very great length, they are wound in several windings next to each other and in several layers one above the other on the cable winch. In the case of multiple layer windings, winding disturbances can occur due to excessively large deflection angles, particularly in the area of the flanged pulleys. This can lead to increased cable wear, which may lead to cable failure.

Consequently, it would be desirable to be able to achieve an improved winding of the cable on the cable winch.

SUMMARY OF THE INVENTION

Therefore, the problem of the present invention is to further develop a cable winch device as well as a crane of the type mentioned in the introduction, particularly with a view to achieve a reduction in cable wear and thus greater safety in terms of avoiding cable failure.

Said problem is solved according to the invention by a cable winch device having the characteristics herein. Accordingly, it is provided that a cable winch device having at least one cable winch, with at least one cable, wherein the cable is wound and/or can be wound and/or unwound at least partially on the cable winch, and provided with at least one shifting means, wherein, by means of the shifting means, the cable winch can be shifted and/or moved at least partially substantially along the longitudinal axis of the cable winch.

This results in the advantage that the deflection angle of the cable can be adjusted independently of the position of the winch on the crane, and independently of other components of the crane, particularly cable guiding elements of the crane, and kept in particular within a justifiable angular range. This angular range of the deflection angle is selected here in such a manner that the maximum achieved deflection angle cannot lead to wear, or only to very minimal wear. In this manner, excessively high deflection angles can be prevented.

In particular, it is now also no longer necessary to adapt the cable winch device in accordance with the different cable angles relative to the boom position of the crane, when the winch is not positioned on the boom. In addition, it is no longer necessary to provide for an additional cable bending change, which is an additional cable sparing measure.

The cable winch device can be in particular a cable winch device for a crane.

Moreover, it is possible to provide that the shifting means comprises at least one linear drive means and/or that the shifting means comprises at least one guide.

Furthermore, it can be provided that the cable winch can be shifted and/or moved at least partially substantially in both directions along the longitudinal axis of the cable winch.

In addition, it is possible that the shifting means comprises a measuring means by means of which the shifting movement of the cable winch can be measured directly and/or indirectly. As a result, it becomes advantageously possible to be able to position the cable winch with high precision. A usage-appropriate positioning of the cable winch can thus be achieved in a simple manner.

In particular, it is conceivable that the measuring means is an electronic measuring means.

Furthermore, it can be provided that the cable is a steel cable. The cable can, however, also be a fiber cable. In particular, such a fiber cable can be plastic cable.

In addition, it is possible that the cable can be wound and/or unwound over at least one stationarily arranged cable pulley. Here, the stationarily arranged cable pulley is in particular a cable pulley which is a component of the cable guiding elements of a crane which is provided with an above-mentioned cable winch device. Here, the stationarily arranged cable pulley can turn about its own rotation axis in order to guide the cable in a winding and/or unwinding process. However, the cable pulley itself cannot be shifted along its rotation axis.

It is conceivable that the cable winch can be shifted and/or moved relative to a reference point, for example, an attachment point, particularly an attachment point for the cable pulley. It is also conceivable that the reference point is a stationarily arranged cable pulley.

In addition, it can be provided that the cable winch can be shifted and/or moved relative to the cable pulley, in particular that it can be shifted and/or moved at least partially substantially in both directions along the longitudinal axis of the cable winch relative to the cable pulley.

Furthermore, it is possible that the cable winch can be shifted and/or moved substantially parallel to the rotation axis of the cable pulley.

In particular, it can be provided that the rotation axis of the cable winch and the rotation axis of the cable pulley are parallel.

Moreover, the present invention relates to a crane having the characteristics herein. Accordingly, it is provided that a crane is provided with at least one cable winch device according to the features herein.

Such a crane can be in particular a deep sea crane. In principle, the invention is not limited to deep sea cranes, because the invention can be used with any kind of crane.

BRIEF DESCRIPTION OF THE DRAWINGS

Additional details and advantages of the invention will now be explained further, using an embodiment example represented in the drawing.

The single FIGURE shows a diagrammatic representation of the cable winch device according to the invention for a crane.

DESCRIPTION OF THE PREFERRED EMBODIMENTS

FIG. 1 shows, in a diagrammatic representation, a cable winch device 10 according to the invention in an advantageous embodiment with a cable winch 20 on which a cable 30 is partially wound.

The cable 30 can here be wound and/or unwound over the cable pulley 70. The cable pulley 70 is here arranged stationarily in the plane B, wherein the plane B in each case is perpendicular to the rotation axis A of the cable winch 20, as well as to the rotation axis C of the cable pulley 70. The cable pulley 70 can move freely only about the rotation axis C, but for the rest it is stationary.

The cable winch 20 can be moved by means of the linear drive 40 and by means of the guides 50 along the rails 52. Here, movability in the two directions along the rotation axis A is possible.

Furthermore, an electronic measuring device is provided, by means of which the positioning of the cable winch relative to the cable pulley 70 can be determined.

The cable 30 is a steel cable 30 of great length, as is required for the use of the cable winch on a deep sea crane. For example, such a steel cable 30 here can have a length of several hundred meters, 500 m or 1000 m, or up to 2500 m, for example, depending on the depth of use. In case of depths of use of more than 2500 m, conventional steel cable winches reach their limits. The reason is the weight of the steel cable itself, which, starting at this length is no longer in any relation with respect to the load capacity of the winch. Instead, plastic cables or fiber cables can then be used on the crane winches. These plastic cables are considerably lighter than similar steel cables; however, they undergo a greater elongation and they are more sensitive to temperature. The depth of use of a 55 t deep sea winch, for example, can be 4000 m with a plastic cable that has a diameter of 56 mm. Such a plastic cable withstands, for example, a load of at least 256 t.

Compared to conventional cable winch devices or spooling devices, the cable winch device according to the invention shown in FIG. 1 is independent of the position of the winch on the crane.

Thus, the system does not have to be adapted in accordance with the different cable angles relative to the boom position, if the cable winch 20 is not positioned on the boom.

Due to the location of the system, the precision of the actuation is less elaborate than with conventional cable winch devices. Since no additional cable bending change is required, in contrast to conventional spooling devices or cable winch devices, there is an additional sparing effect for the cable 30. The actuation is carried out electronically and not mechanically as in conventional cable winch devices, and as a result the number of components that undergo wear is minimized. The electronic actuation allows additional optimization measures in the rising area of the cable 30, which are impossible with conventional, mechanically actuated systems.

In order to unwind the cable 30, for example, from the cable winch 20, as represented in FIG. 1, the cable 30 is unwound by means of the drive—not shown in further detail—of the cable winch 20, and led over the cable pulley 70. In order to prevent the angle formed by the cable 30 and the plane B from becoming excessively large, a position correction of the cable winch 20 occurs by moving the cable winch 20 relative to a reference point which is located in the plane B, for example, or relative to the cable pulley 70.

The position determination of the relative positions with respect to each other of the cable 30, the cable winch 20, and the cable pulley 70, can occur directly and/or indirectly via the measuring means 60, by means of which the shifting movement of the cable winch 20 relative to a reference point, which is located in the plane B, for example, or relative to the cable pulley 70, can be measured directly and/or indirectly. The measuring means 60 is an electronic measuring means 60 in the embodiment shown in FIG. 1.

For position correction, once a threshold value for the angle which is formed by the cable 30 and the plane B has been reached, the cable winch 20 is moved by means of the linear drive 40 and by means of the guides 50 along the rails 52, so that the angle formed by the cable 30 and the plane B is again less than the threshold value. This threshold value can be in a range between 0.5° and 1.5°, for example.

The winding process of the cable 30 over the cable pulley 70 onto the cable winch 20 occurs in accordance with the above-described unwinding process of the cable 30.

The linear drive 40 can be formed, for example, by one or more hydraulic cylinders which are not shown in further detail, or it can comprise one or more hydraulic cylinders, particularly two hydraulic cylinders. In principle, any type of linear drive can be used in connection with the invention, including also pneumatic and/or electrical and/or mechanical linear drives, for example.

The invention claimed is:

1. Cable winch device (10), having at least one cable winch (20), at least one cable (30) being at least partially windable and unwindable on the cable winch (20), at least one means (40) for at least partially shifting or moving the cable winch (20) substantially along a longitudinal axis of the cable winch (20), at least one stationarily-arranged cable pulley (70) about which the at least one cable (30) is wound and with the cable winch (20) being shiftable or movable relative to a reference point (B) of the at least one stationarily-arranged cable pulley (70), and the shifting means (40) comprise means (60) for directly or indirectly measuring the shifting movement of the cable winch (20) with respect to the reference point (B) of the at least one stationarily-arranged cable pulley 70.

2. Cable winch device (10) according to claim 1, wherein the shifting means comprises at least one of linear drive means (40) and at least one guide (50).

3. Cable winch device (10) according to claim 1, wherein the cable winch (20) is movable or shiftable at least partially substantially in two directions along the longitudinal axis of the cable winch (20).

4. Cable winch device (10) according to claim 1, wherein the measuring means (60) is an electronic measuring means (60).

5. Cable winch device (10) according to claim 1, wherein the cable (30) is a steel cable (30) or a fiber cable.

6. Cable winch device (10) according to claim 1, wherein the cable winch (20) is shiftable or movable at least partially substantially in the two directions along the longitudinal axis of the cable winch (20) relative to the cable winch (70).

7. Cable winch device (10) according to claim 6, wherein the cable winch (20) is shiftable or movable substantially parallel to a rotation axis of the cable pulley (70).

8. A crane having at least one cable winch device (10) according to claim 1.

9. Cable winch device (10) according o claim 1, wherein the at least one cable winch (20) and at least one stationarily-arranged cable pulley (70) are oriented with respective axes of rotation (A, C) substantially parallel, and with the at least one cable pulley (70) stationarily-arranged on a plane (B) substantially perpendicular to the respective axes of rotation (A, C), the shifting means (40) are arranged to correct position of the cable winch (20) relative to a reference point located on the plane (B) to prevent an angle formed by the cable (30) and plane (B) from becoming excessively large, and the measuring means (60) measure shifting relative positions of the cable (30), cable winch (20) and cable pulley (70) with respect to one another and shifting movement of the cable winch (20) relative to the reference point located on the plane (B).

10. Cable winch device (10) according to claim 9, wherein said shifting means (40) include guides (50) and rails (52) on which the guides (50) are respectively mounted for movement in opposite directions.

11. Cable winch device (10) according to claim 10, wherein said measuring means (60) are mounted on the axis of rotation (A) of the cable winch (20) adjacent one of the guides (50).

12. Cable winch device (10) according to claim 11, wherein said means (40) for at least partially shifting or moving the cable winch (20) include a linear drive (40).

13. Cable winch device (10) according to claim 12, wherein said linear drive (40) is formed by at least one hydraulic cylinder.

14. Cable winch device (10) according to claim 1, wherein said shifting means (40) are arranged to maintain angle of the cable (30) and a plane (B) along which the reference point is situated, below a threshold value.

15. Cable winch device according to claim 14, wherein the threshold value falls between 0.5° and 1.5°.

16. Cable winch device (10) according to claim 1, wherein said shifting means (40) include guides (50) and rails (52) on which the guides (50) are respectively mounted for movement in opposite directions.

17. Cable winch device (10) according to claim 16, wherein said measuring means (60) are mounted on the axis of rotation (A) of the cable winch (20) adjacent one of the guides (50).

* * * * *